United States Patent [19]

Watanabe

[11] Patent Number: 4,995,016

[45] Date of Patent: Feb. 19, 1991

[54] TIMEPIECE WITH LIGHT EMITTING DEVICE

[75] Inventor: Isato Watanabe, Tokyo, Japan

[73] Assignee: Seikosha Co., Ltd., Japan

[21] Appl. No.: 422,630

[22] Filed: Oct. 17, 1989

[30] Foreign Application Priority Data

Oct. 17, 1988 [JP] Japan ..... 63-260868

[51] Int. Cl.[5] ..... G04B 19/22

[52] U.S. Cl. ..... 368/67; 368/68; 368/227

[58] Field of Search ..... 368/10, 12, 67–68, 368/72–74, 79, 82–83, 250, 256, 227, 241; 315/360, 169.3

[56] References Cited

U.S. PATENT DOCUMENTS

| | | | |
|---|---|---|---|
| 3,913,312 | 10/1975 | Numabe | 368/67 |
| 4,006,583 | 2/1977 | Vuilleumier | 368/68 |
| 4,207,734 | 6/1980 | Moyer | 368/83 |
| 4,253,170 | 2/1981 | Meisner | 368/67 |
| 4,423,963 | 1/1984 | Suzuki | 368/68 |
| 4,527,096 | 7/1985 | Kindlmann | 368/67 |

*Primary Examiner*—Vit W. Miska

*Attorney, Agent, or Firm*—Bruce L. Adams; Van C. Wilks

[57] ABSTRACT

A timepiece comprises a display including a light emitting element. A detector detects ambient light around the timepiece and a switch is switchable into first and second operating modes. When the switch is in the first mode the light emitting element is illuminated at a first brightness level when the detected ambient light is below a predetermined level and the light emitting element is not illuminated when the detected ambient light is above the predetermined level. When the switch is in the second mode, the light emitting element is illuminated at a second brightness level which is greater than the first brightness level.

9 Claims, 3 Drawing Sheets

TIMEPIECE WITH LIGHT EMITTING DEVICE

BACKGROUND OF THE INVENTION

1. [Field of Industrial Application]

The present invention relates to a timepiece with a light emitting device, in which a light emitting element is mounted on the display portion (e.g., hands, letters or clockface) of the timepiece.

2. [Prior Art]

There exists in the prior art a timepiece with a light emitting device, in which a light emitting element such as an EL (Electro Luminescence) element is mounted on the display portion (e.g., hands, letters or clockface) of the timepiece so that it may be easily observed even when the surroundings are dark as in the nighttime.

In this timepiece with the light emitting device, the brightness of the light emitting element is as low as possible so that the power consumption may be minimized.

3. [Problems to Be Solved]

In the aforementioned timepiece with the light emitting device of the prior art, the illumination of the light emitting element cannot be sufficiently recognized even if it is demonstrated when the surroundings are bright as in the daytime. If the brightness of the light emitting element is so increased that it can be sufficiently recognized even in the daytime, the power consumption is accordingly increased to raise a disadvantage that the battery runs out within a short time.

SUMMARY OF THE INVENTION

The present invention has been conceived so as to solve the above-specified problems of the prior art and has an object to provide a timepiece with a light emitting device, in which the illumination of the light emitting element can be sufficiently recognized even when the surroundings are bright.

[EMBODIMENTS]

The present invention will be described in the following in connection with its embodiments with reference to the accompanying drawings.

EMBODIMENT 1

Figure 1:
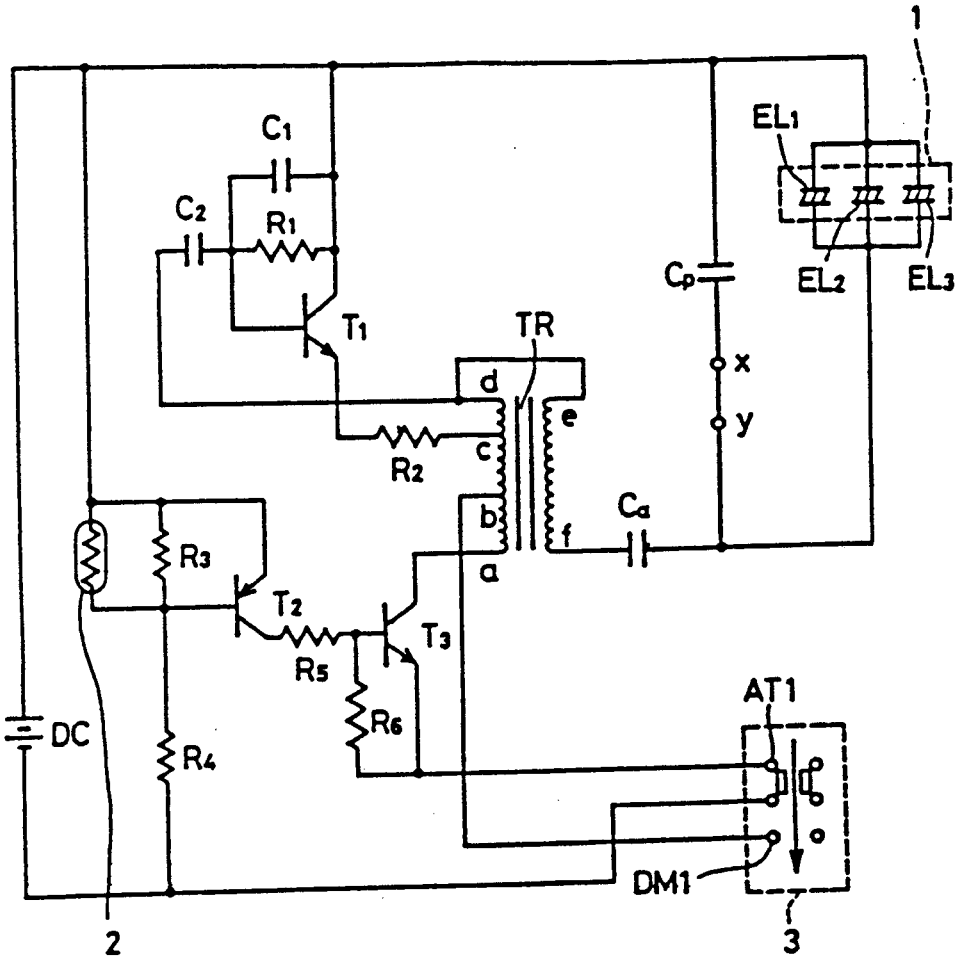
FIG. 1 is an electric circuit diagram showing the first embodiment of the present invention.

FIG. 1 shows a first embodiment of the present invention.

In FIG. 1, reference numeral 1 designates a light emitting element which is disposed on the display portions of a timepiece such as the hands of the timepiece, the letters or numerals indicating the time, or the face of the timepiece and which is composed of EL elements EL1, EL2 and EL3. Numeral 2 designates light detecting means for detecting the brightness around the timepiece. This light detecting means is composed of a photoconductive cell such as CdS (i.e., cadmium sulfur). Numeral 3 designates switching means for switching a first mode, in which the light emitting element 1 is caused to illuminate with a predetermined brightness when in the darkness where the brightness of the light detected by the light detecting means 2 is lower than a predetermined brightness and not to illuminate when in the brightness where the detected brightness is higher than a predetermined brightness, and a second mode in which the light emitting element 1 is caused to illuminate more brightly than the illumination in the darkness of the first mode.

The EL elements used in the light emitting element 1 have to be driven with an AC voltage of several tens of volts or more so that they may be caused to illuminate. In the present embodiment, resistors R1 and R2, capacitors C1, C2, Ca and Cp, a transformer TR, a transistor T1 and the EL elements EL1, EL2 and EL3 constitute altogether a blocking oscillator for driving the EL elements used in the light emitting element 1 with the AC voltage. Usually, the DC voltage (of about 3 V) of a DC power source DC using a battery is converted into an AC voltage (of an effective value of 40 to 80 V) having a frequency of several hundred Hz, which is applied to the EL elements.

The capacitor Ca connected between the transformer TR and the EL elements EL1, EL2 and EL3 is effective for the blocking oscillator to oscillate stably even if a leakage is caused between the two electrodes of the EL elements EL1, EL2 and EL3. The capacitance of the capacitor Ca is preferably five or more times as large as the parallel capacitance of the EL elements EL1, EL2 and EL3. Despite this fact, however, the capacitor Ca may be omitted if there is no fear of leakage between the two electrodes of the EL elements EL1, EL2 and EL3.

The capacitor Cp connected in parallel with the EL elements EL1, EL2 and EL3 is used to drop the frequency for the alternate drive to thereby elongate the lifetimes of the EL elements EL1, EL2 and EL3 (It is generally said that the lifetimes of the EL elements are inversely proportional to the drive frequency).

In the transformer TR, the connection a - c or b -c constitutes a primary side, a connection c - d constitutes a secondary side, and a connection e - f constitutes a ternary side.

Next, the switching of the switching means 3 and the light emitting states of the light emitting element 1 accompanying the changes in the amount of the light detected by the light detecting means 2 will be described in the following. (A) In the operation when the switching means 3 is set in the first mode (i.e., when the switch is set at AT1):

When the switching means 3 is set in the first (auto-) mode in which the light emitting state of the light emitting element 1 is automatically set in accordance with the brightness around the timepiece, the following operations are accomplished in accordance with the brightness of the light detected by the light emitting element 2.

First of all, the following operations are accomplished when the brightness of the light detected by the light detecting means 2 is lower than a predetermined brightness (of several luxes in the present embodiment).

The photoconductive cell used as the light detecting means 2 has its resistance raised to a high value to turn on a transistor T2 so that a transistor T3 is accordingly turned on. As a result, the transformer TR has its connection a - c constituting the primary side to apply the predetermined AC voltage (e.g., 50 V) to the EL elements EL1, EL2 and EL3 so that the light emitting element 1 illuminates with a low luminance.

Next, the following operations are accomplished when the brightness of the light detected by the light detecting means 2 is higher than a predetermined brightness.

The photoconductive cell used as the light detecting means 2 has its resistance dropped to a low level to turn off the transistor Tr2 so that the transistor T3 is also turned off. As a result, no current flows to the primary side of the transformer TR to apply no AC voltage to the EL elements EL1, EL2 and EL3 so that the light emitting element 1 does not illuminate. (B) In the operation when the switching means 3 is set in the second mode (i.e., when the switch is set at DM1):

When the switching means 3 is set in the second mode (i.e., the demonstration mode) in which the light emitting element 1 is caused to illuminate with a high luminance, the following operations are accomplished.

The transformer TR has its connection b - c constituting the primary side. Since the number of turns of the primary side is smaller than that of the foregoing operation (A), the EL elements EL1, EL2 and EL3 are fed with a higher AC voltage (e.g., 75 V) than that of the operation (A) so that the light emitting element 1 illuminates with a high luminance. In the present embodiment, as is apparent form FIG. 1, the light emitting element 1 illuminates with the high luminance independently of the brightness of the light detected by the light detecting means 2.

Since, in this mode, the light emitting element 1 illuminates highly brightly even if the surroundings are bright as in the daytime, the illumination of the light emitting element 1 can be recognized without fail. This highly bright emission is effective especially when the light emitting element 1 is caused to demonstrate in the bright surroundings.

Here, generally speaking, it is known in the art that the emission luminance of an EL element is proportional to the frequency of the AC drive. Thus, when the switching means 3 is set in the first (auto-) mode described in the foregoing item (A), the connection x -y of FIG. 1 is electrically shorted to connect the capacitor Cp in parallel with the EL elements EL1, EL2 and EL3 so that these elements EL1, EL2 and EL3 may be alternatively driven with a low frequency. When, on the other hand, the switching means 3 is set in the second mode (i.e., the demonstration mode) described in the foregoing item (B), the connection x - y of FIG. 1 is electrically opened to disconnect the capacitor Cp so that the EL elements EL1, EL2 and EL3 are driven with the AC voltage of high frequency. In these ways, too, it is possible to control the low- and high-luminance illuminations by the EL elements EL1, EL2 and EL3. At this time, it is not always necessary to increase or decrease the number of turns of the primary side for each mode.

In the present embodiment, the modes may be suitably switched, as follows. The switching means is usually set at the first (auto-) mode so that the light emitting elements may automatically illuminate with the low luminance when the surroundings are dark (or in the darkness). When the surroundings are bright (or in the brightness), the switching means is desirably set at the second mode (i.e., the demonstration mode) so that the light emitting elements may illuminate with the high luminance. As a result, in the normal state, the light emitting elements can illuminate automatically with the low luminance only in the darkness to reduce the power consumption. If necessary, moreover, another setting can be so made that the light emitting elements may illuminate with the high luminance. Thus, the socalled "demonstration function" can be performed with an excellent visibility even when the surroundings are bright.

EMBODIMENT 2

Figure 2:
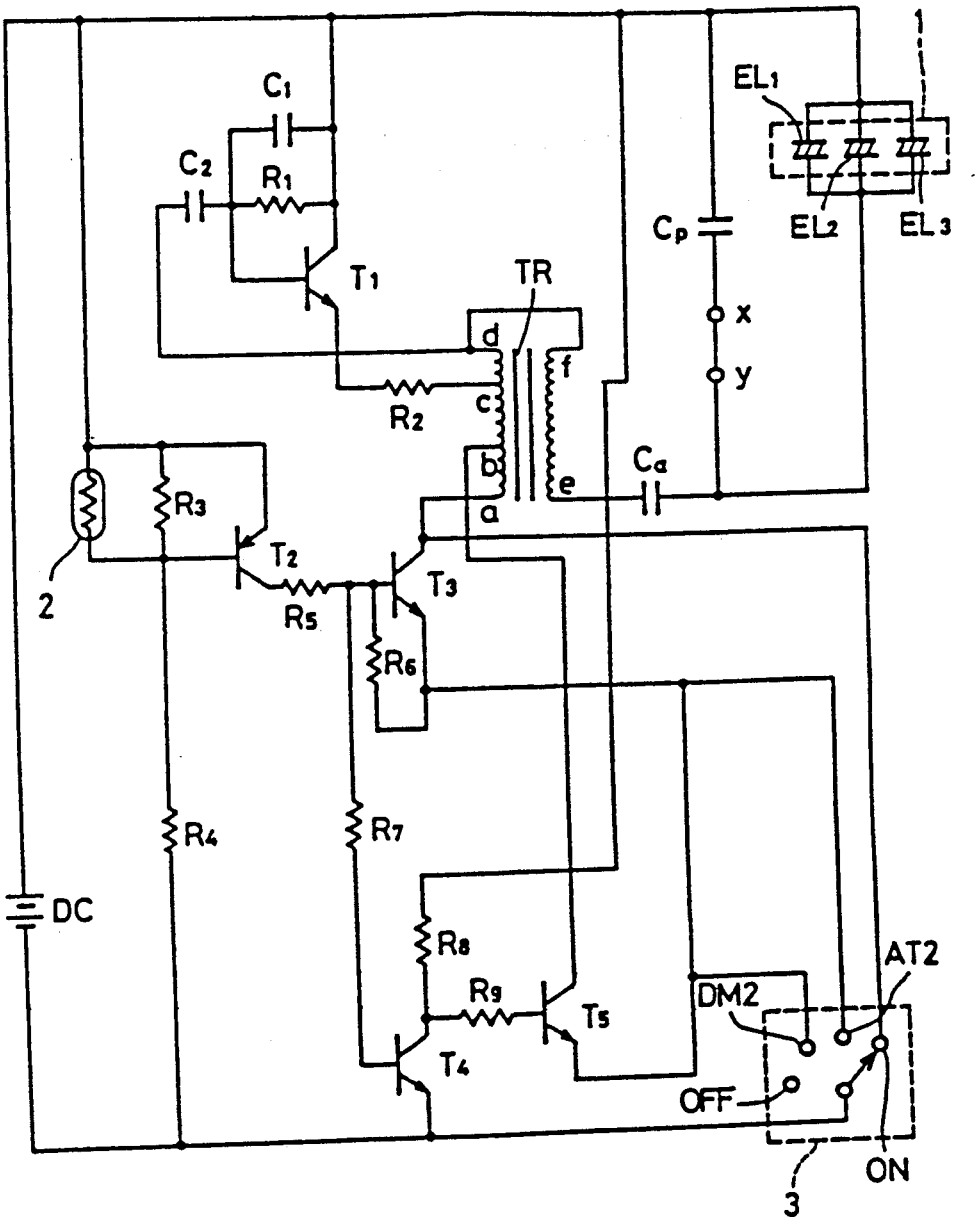
FIG. 2 is an electric circuit diagram showing the second embodiment of the present invention.

FIG. 2 shows another embodiment of the present invention.

In FIG. 2, the numerals and symbols identical to those of FIG. 1 have the same functions as those of the foregoing embodiment excepting those as will be described in the following. Therefore, these are fundamentally similar to those of the first embodiment so that their descriptions will be omitted.

The switching of the switching means 3 and the light emitting states of the light emitting element 1 accompanying the changes in the amount of the light detected by the light detecting means 2 will be described in the following.

(C) In the operation when the switching means 3 is set in the first mode (i.e., when the switch is set at AT2):

The functions and operations at this time are similar to those of the aforementioned case (A) of the first embodiment, and their descriptions will be omitted.

(D) In the operation when the switching means 3 is set in the third mode (i.e., when the switch is set at DM2):

The following operations are accomplished when the switching means 3 is set in the third mode (i.e., the demonstration mode) in which the light emitting element 1 is caused to illuminate with a high or low brightness.

First of all, the following operations are accomplished when the brightness of the light detected by the light detecting means 2 is higher than a predetermined brightness (e.g., several luxes in the present embodiment).

Since the photoconductive cell used as the light detecting means 2 has its resistance reduced to a low level, the transistor T2 is turned off so that the transistor T3 is also turned off. Since, moreover, a transistor T4 is also off, a transistor T5 is turned on by the actions of resistors R8 and R9. As a result, the transformer TR has its b - c connection constituting the primary side, the number of turns of the primary side is smaller than that of the mode (C) so that the EL elements EL1, EL2 and EL3 are fed with a higher AC voltage (e.g., 75 V) than that of the foregoing mode (C) to cause the light emitting element 1 to illuminate with a high luminance.

Next, the following operations are accomplished in the darkness when the brightness of the light detected by the light detecting means 2 is lower than a predetermined brightness.

The photoconductive cell used as the light emitting means 2 has its resistance raised to a high level to turn on the transistor T2 so that the transistor T3 is turned on. As a result, the transistor TR has its a- c connection constituting the primary side to apply a predetermined AC voltage (e.g., 50 V) to the El elements EL1, EL2 and EL3 so that the light emitting element 1 illuminates with a low luminance.

Since, in this mode, the light emitting element 1 illuminates highly brightly even if the surroundings are bright as in the daytime, the illumination of the light emitting element 1 can be recognized without fail. This highly bright emission is effective especially when the light emitting element 1 is caused to demonstrate in the bright surroundings. When, on the contrary, the surroundings are dark as in the night, the illumination of the light emitting element 1 can also be recognized without fail even if its luminance is low. Thus, the power consumption can be reduced by causing the light emitting element 1 to illuminate with a low luminance.

(E) In the operation when the switching means 3 is normally set in the illuminating mode (i.e., when the switch is set at ON):

In this mode, the light emitting element 1 is always caused to illuminate with a low luminance independently of the brightness of the light detected by the light detecting means 2.

In the present mode, as is apparent from FIG. 2, the transformer TR has its connection a - c constituting the primary side independently of the brightness of the light detected by the light detecting means 2. As a result, the predetermined AC voltage (e.g., 50 V) is applied to the EL elements EL1, EL2 and EL3 so that the light emitting element 1 illuminates with a low luminance.

(F) In the operation when the switching means 3 is normally set in the non-illuminating mode (i.e., when the switch is set at OFF):

In the present mode, as is apparent from FIG. 2, no current flows to the primary side of the transformer TR to apply no AC voltage to the EL elements EL1, EL2 and EL3 so that the light emitting element 1 does not illuminate at all times.

In the present embodiment, it is not necessary to set the aforementioned (E) (the normally illuminating mode) of (F) (the normally non-illuminating mode).

In the present embodiment, the switching means may normally be set at the first (auto-) mode so that the light emitting element may illuminate with the low luminance when the surroundings become dark (in the darkness). When the surrounding are bright (in the brightness), the switching means may be set, if necessary, to the third mode (i.e., the demonstration mode) to cause the light emitting element to illuminate with the high luminance. As a result, in the normal state, the light emitting elements can illuminate automatically with the low luminance only in the darkness to reduce the power consumption. If necessary, moreover, another setting can be so made that the light emitting elements may illuminate with the high luminance. Thus, the so-called "demonstration function" can be performed with an excellent visibility even when the surroundings are bright. In case, on the other hand, the switching means is set to the third mode (i.e., the demonstration mode) when the surroundings are dark as in the night, the light emitting element illuminates with the low luminance so that the power consumption can be reduced to a lower value than that of the foregoing first embodiment (in which the light emitting element always illuminates with the high luminance in the demonstration mode independently of the brightness of the surroundings).

Incidentally, the switching means can be set to the "normally non-illuminating mode" in the bedtime of night and to the third mode, when the time is to be confirmed in the bedtime, so that the light emitting element may illuminate with the low luminance.

EMBODIMENT 3

Figure 3:
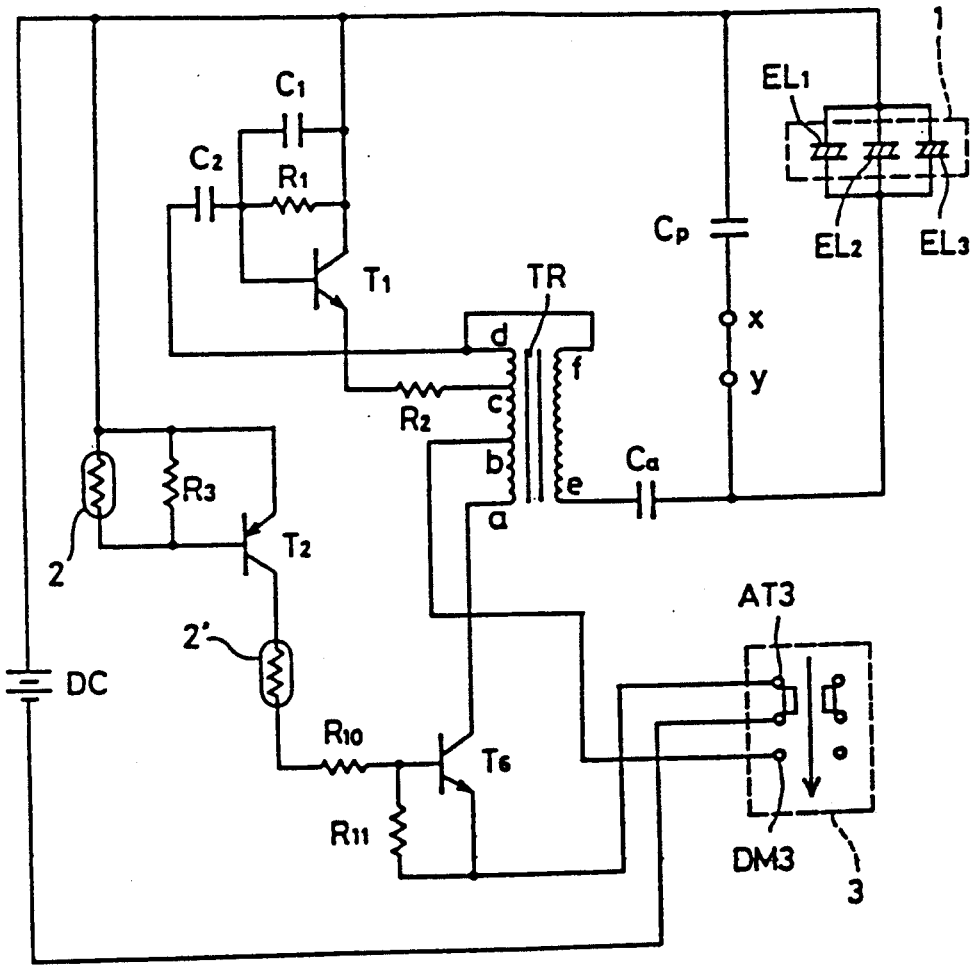
FIG. 3 is an electric circuit diagram showing the third embodiment of the present invention.

FIG. 3 shows a third embodiment of the present invention.

In FIG. 3, the numerals and symbols identical to those of FIG. 1 have the same functions as those of the first embodiment excepting those as will be described in the following. Therefore, these are fundamentally similar to those of the first embodiment so that their descriptions will be omitted.

The switching of the switching means 3 and the light emitting states of the light emitting element 1 accompanying the changes in the amount of the light detected by the light detecting means 2 will be described in the following.

(G) In the operation when the switching means 3 is set in the fourth mode (i.e., when the switch is set at AT3):

When the switching means 3 is set in the first (auto-) mode in which the light emitting state of the light emitting element 1 is automatically set in accordance with the brightness around the timepiece, the following operations are accomplished in accordance with the brightness of the light detected by the light emitting element 2.

First of all, the following operations are accomplished when the brightness of the light detected by the light detecting means 2 is lower than a predetermined brightness (of several luxes in the present embodiment).

In accordance with the brightness of the light detected by light detecting means 2', the resistance of photosensitive cell is changed such that it takes the larger value for the lower brightness. In accordance with the magnitude of the resistance, the bias voltage of a transistor T6 is changed. As is apparent from FIG. 3, the transformer TR has its connection a - c constituting the primary side which has its current changing with the conductivity of the transistor T6. Specifically, the current flowing through the transformer TR is reduced to the lower rate as the brightness of the light detected by the light detecting means 2 is the lower, so that the AC voltage to be applied to the EL elements EL1, EL2 and EL3 is reduced to drop the brightness of the light emitting element 1.

Since, in this present mode, the light emitting element 1 is set to illuminate with the lower luminance in the darker surroundings of the timepiece, it can be caused to illuminate with the optimum brightness for the brightness of the surroundings so that the display of the timepiece can become obvious.

Next, the following operations are accomplished in the brightness where the brightness of the light detected by the light detecting means 2 is higher than a predetermined brightness.

The photoconductive cell used as the light detecting means 2 has its resistance dropped to a lower value to turn off the transistor T2 so that the transistor T6 is also turned off. As a result, no current flows to the primary side of the transformer TR, and the no AC voltage is applied to the EL elements EL1, EL2 and EL3 so that the light emitting element 1 does not illuminate.

(H) In the operation when the switching means 3 is set in the fifth mode (i.e., when the switch is set at DM3):

The following operations are accomplished when the switching means 3 is set in the second mode (i.e., the demonstration mode) where the light emitting element 1 is caused to illuminate with a high luminance.

The transformer TR has its connection b - c constituting the primary side. Since the number of turns of the primary side resultantly becomes less than that of the aforementioned mode (G), the EL elements EL1, EL2 and EL3 are fed with a higher AC voltage (e.g., 75 V) than the highest AC voltage (e.g., 50 V) supplied in the mode (G) so that the light emitting element 1 illuminates with the high luminance. In the present embodiment, as is apparent from FIG. 3, the light emitting element 1 illuminates with the high luminance independently of the brightness of the light detected by the light detecting means 2.

In the present mode, the light emitting element 1 illuminates with the high luminance even when the surroundings are bright as in the daytime, so that the illumination of the light emitting element 1 can be recognized without fail. This illumination is effective especially if the light emitting element 1 is caused to demonstrate when the surroundings are bright.

In the present embodiment, the switching means is normally set in the fourth (auto-) mode only in the darkness, so that the light emitting element may illuminate within a low-luminance region in accordance with the brightness of the surroundings, and in the fifth mode (i.e., the demonstration mode), if necessary, when the surroundings are bright (in the brightness), so that the light emitting element may illuminate with the high luminance. As a result, the light emitting element can be normally caused to illuminate in the lowluminance region only in the darkness in accordance with the brightness of the surroundings to reduce the power consumption. If necessary, moreover, the light emitting element can be set to illuminate with the high luminance so that the so-called "demonstration function" can be performed with an excellent visibility even if the surroundings are bright.

Although the present invention has been described hereinbefore in connection with its first, second and third embodiments, it should not be limited to those embodiments. The following modifications can be attained according to the present invention.

For example, the brightness of the light emitting element using the EL elements can also be controlled by changing not the amplitude of the AC voltage to be applied to the EL elements but the frequency of the AC voltage applied intermittently to the EL elements and changing the duty ratio.

Moreover, the following functions can be effectively added to the timepiece equipped with the light emitting device according to the present invention.

For example, the light emitting element is flashed with an arbitrary period. When the surroundings are so dark that the display of the timepiece cannot be observed, the light emitting element disposed in the display of the timepiece is caused to illuminate, as has been described hereinbefore. For the time recognition, it is not always necessary to cause the light emitting element to illuminate continuously, but the recognition can also be achieved by the flashing illumination with a suitable period. In these manners, the energy to be consumed by the light emitting element can be reduced. Incidentally, the flashing period may preferably be 1 to 2 seconds and can be achieved in an analog piece time by using motor driving pulse signals.

[EFFECTS]

(1) In the structure including switching means for switching a first mode, in which said light emitting element is caused to illuminate with a predetermined brightness when in the darkness where the brightness of the light detected by said light detecting means is lower than a predetermined brightness and not to illuminate when in the brightness where the detected brightness is higher than a predetermined brightness, and a second mode in which said light emitting element is caused to illuminate more brightly than the illumination in the darkness of said first mode, the light emitting element is normally enabled to illuminate automatically with a low luminance only in the darkness thereby to reduce the power consumption and, if necessary, to illuminate with a high luminance so that the so-called "demonstration function" can be achieved excellently visibly even if the surroundings are bright.

(2) In the structure including switching means for switching a first mode, in which said light emitting element is caused to illuminate with a predetermined brightness when in the darkness where the brightness of the light detected by said light detecting means is lower than a predetermined brightness and not to illuminate when in the brightness where the detected brightness is higher than a predetermined brightness, and a third mode in which said light emitting element is caused to illuminate in the brightness more brightly than the illumination in the darkness in said first mode and in the darkness more darkly than the illumination in said brightness, the light emitting element is normally enabled to illuminate automatically with a low luminance only in the darkness thereby to reduce the power consumption and, if necessary, to illuminate with a high luminance so that the so-called "demonstration function" can be achieved excellently visibly even in the daytime. In case, moreover, the switching means is set in the third mode (i.e., the demonstration mode) when the surroundings are dark as in the nighttime, the light emitting element illuminates with the low luminance the power consumption can be reduced to a lower value than that of the foregoing first embodiment (in which the light emitting element always illuminates with the high luminance independently of the brightness of the surroundings).

(3) In the structure including switching means for switching a fourth mode, in which said light emitting element is caused to illuminate the more darkly when in the darkness where the brightness of the light in accordance with the brightness of the surroundings detected by said light detecting means is lower than a predetermined brightness and not to illuminate when in the brightness where the detected brightness is higher than a predetermined brightness, and a fifth mode in which said light emitting element is caused to illuminate more brightly than the highest brightness of the illumination in said fourth mode, the light emitting element is normally enabled to illuminate with a low luminance only in the darkness in accordance with the brightness of the surroundings thereby to reduce the power consumption and, if necessary, to illuminate with a high luminance so that the so-called "demonstration function" can be achieved excellently visibly even if the surroundings are bright.

I claim:

1. A timepiece having a light emitting device, comprising:

a light emitting element mounted on a display portion of said timepiece;

light detecting means for detecting the brightness around said timepiece; and switching means for switching into a first mode, in which said light emitting element is caused to illuminate when in the darkness where the brightness of the light detected by said light detecting means is lower than a predetermined brightness and not to illuminate when in the brightness where the detected brightness is higher than a predetermined brightness, and into a second mode in which said light emitting element is caused to illuminate more brightly than the illumination in the darkness of said first mode.

2. A timepiece having a light emitting device, comprising:

a light emitting element mounted on a display portion of said timepiece;

light detecting means for detecting the brightness around said timepiece; and switching means for switching into a first mode, in which said light emitting element is caused to illuminate when in the darkness where the brightness of the light detected by said light detecting means is lower than a predetermined brightness and not to illuminate when in the brightness where the detected brightness is higher than a predetermined brightness, and into a second mode in which said light emitting element is caused to illuminate in the brightness more brightly than the illumination in the darkness in said first mode and in the darkness more darkly than the illumination in said brightness in the second mode.

3. A timepiece having a light emitting device, comprising:

a light emitting element mounted on a display portion of said timepiece;

light detecting means for detecting the brightness around said timepiece; and switching means for switching into a first mode, in which said light emitting element is caused to illuminate with a lower luminance for darker surroundings when in the darkness where the brightness of the light detected by said light detecting means is lower than a predetermined brightness and not to illuminate when in the brightness where the detected brightness is higher than a predetermined brightness, and into a second mode in which said light emitting element is caused to illuminate more brightly than the highest brightness of the illumination in said first mode.

4. A timepiece comprising: a display including a light emitting element; means for detecting ambient light around the timepiece; switching means for switching into first and second operating modes; and means operable when the switching means is in the first mode to illuminate the light emitting element at a first brightness level when the detected ambient light is below a predetermined level and for not illuminating the light emitting element when the detected ambient light is above the predetermined level and operable in the second mode to illuminate the light emitting element at a second brightness level greater than the first brightness level.

5. A timepiece according to claim 4, wherein the switching means is switchable into a third operating mode, and the illuminating means is operable when the switching means is in the third mode to illuminate the light emitting element at a third brightness level greater than the first brightness level when the detected ambient light is above a third predetermined level and to illuminate the light emitting element at a fourth brightness level lower than the third brightness level when the detected ambient light is below the third predetermined level.

6. A timepiece according to claim 4, wherein the switching means is switchable into fourth and fifth operating modes and the illuminating means is operable when the switching means is in the fourth mode to illuminate the light emitting element at a brightness level which increases as the detected ambient light increases when the detected ambient light is lower than a predetermined level and for not illuminating the light emitting element when the detected ambient light is above the predetermined level and operable in the fifth mode to illuminate the light emitting element at a second brightness level greater than the highest brightness level of the light emitting element in the fourth mode.

7. A timepiece according to claim 5, wherein the switching means is switchable into fourth and fifth operating modes and the illuminating means is operable when the switching means is in the fourth mode to illuminate the light emitting element at a brightness level which increases as the detected ambient light increases when the detected ambient light is lower than a predetermined level and for not illuminating the light emitting element when the detected ambient light is above the predetermined level and operable in the fifth mode to illuminate the light emitting element at a second brightness level greater than the highest brightness level of the light emitting element in the fourth mode.

8. A timepiece comprising: a display including a light emitting element; means for detecting ambient light around the timepiece; switching means for switching between first and second operating modes; and means operable when the switching means is in the first mode to illuminate the light emitting element at a first brightness level when the detected ambient light is below a first predetermined level and for not illuminating the light emitting element when the detected ambient light is above the first predetermined level and operable in the second mode to illuminate the light emitting element at a second brightness level greater than the first brightness level when the detected ambient light is above a second predetermined level and to illuminate the light emitting element at a third brightness level lower than the second brightness level when the detected ambient light is below the second predetermined level.

9. A timepiece comprising: a display including a light emitting element; means for detecting ambient light around the timepiece; switching means for switching between first and second operating modes; and means operable when the switching means is in the first mode to illuminate the light emitting element at a brightness level which increases as the detected ambient light increases when the detected ambient light is lower than a predetermined level and for not illuminating the light emitting element when the detected ambient light is above the predetermined level and operable in the second mode to illuminate the light emitting element at a second brightness level greater than the highest brightness level of the light emitting element in the first mode.

* * * * *